US006349438B1

(12) United States Patent
Coleman et al.

(10) Patent No.: US 6,349,438 B1
(45) Date of Patent: Feb. 26, 2002

(54) HYDRAULICALLY ACTUATED VARIABLE HEIGHT LEG PILLOW SUPPORT APPARATUS

(76) Inventors: Gerald Coleman; Kim A. Coleman, both of 45 Waterford Dr., Bordentown, NJ (US) 08505

( * ) Notice: Subject to any disclaimer, the term of this patent is extended or adjusted under 35 U.S.C. 154(b) by 0 days.

(21) Appl. No.: 09/556,346

(22) Filed: Apr. 24, 2000

(51) Int. Cl.[7] ..... A47C 16/00; A47C 20/12; A61G 7/075

(52) U.S. Cl. ..... 5/648; 5/651; 297/423.41; 297/423.45

(58) Field of Search ..... 5/648, 649, 650, 5/651, 624; 297/423.39, 423.41, 423.44, 423.45, 423.46

(56) References Cited

U.S. PATENT DOCUMENTS

| | | | | | |
|---|---|---|---|---|---|
| 621,098 | A | * | 3/1899 | Kelly | 297/423.45 X |
| 2,067,891 | A | * | 1/1937 | Comper | 5/624 |
| 2,170,724 | A | * | 8/1939 | Marquardt | 5/651 X |
| 2,375,225 | A | * | 5/1945 | Herbert | 5/651 |
| 2,465,781 | A | * | 3/1949 | Banta | 5/650 |
| 2,748,838 | A | * | 6/1956 | Scholl | 297/423.41 |
| 2,878,493 | A | * | 3/1959 | Delia | 5/651 |
| 3,162,486 | A | * | 12/1964 | Emery | 297/423.41 |
| 3,308,489 | A | | 3/1967 | Winkler | 5/648 |
| 3,345,654 | A | * | 10/1967 | Noble | 5/651 X |
| 3,482,566 | A | * | 12/1969 | Watkins | 5/651 X |
| 4,232,681 | A | * | 11/1980 | Tulaszewski | 5/648 X |
| 4,426,071 | A | * | 1/1984 | Klevstad | 5/624 X |
| 4,586,207 | A | * | 5/1986 | Cornette | 5/651 X |
| 5,024,485 | A | * | 6/1991 | Berg et al. | 297/312 |
| 5,369,827 | A | * | 12/1994 | Parke et al. | 5/651 X |
| 5,497,520 | A | | 3/1996 | Kunz et al. | 5/648 |
| 5,603,336 | A | * | 2/1997 | Shepich | 5/650 X |
| 5,708,999 | A | | 1/1998 | Priolo et al. | 5/644 |
| 5,765,921 | A | * | 6/1998 | Chuang | 297/423.46 |
| 5,771,514 | A | | 6/1998 | Wilhoit | 5/644 |
| 5,898,963 | A | | 5/1999 | Larson | 5/644 |
| 5,978,991 | A | * | 11/1999 | Miles | 5/651 |
| 6,108,841 | A | * | 8/2000 | Cameron et al. | 5/648 |

FOREIGN PATENT DOCUMENTS

| | | | | |
|---|---|---|---|---|
| DE | 2723322 A | * | 10/1978 | 297/423.46 |

* cited by examiner

*Primary Examiner*—Robert G. Santos
(74) *Attorney, Agent, or Firm*—Henderson & Sturm LLP

(57) ABSTRACT

A remote controlled variable height leg pillow support apparatus (10) including a support unit (11) comprising a pair of independently movable contoured foot support members (20), (20') each having a molded foam foot rest (22) which is suspended above a base member (30) by two separate pairs of hydraulic piston members (40). Each of the two separate pairs of hydraulic piston members (40) associated with each of the foot support members (20), (20') are independently responsive to a remote control member (60) which activates a microprocessor (52) which controls a plurality of stepping motors (50). Each stepping motor (50) is connected to one of the hydraulic piston members (40) for independently raising and lowering the foot support members (20), (20').

9 Claims, 2 Drawing Sheets

HYDRAULICALLY ACTUATED VARIABLE HEIGHT LEG PILLOW SUPPORT APPARATUS

BACKGROUND OF THE INVENTION

1. Field of the Invention

The present invention relates to the field of adjustable contour pillow constructions in general, and in particular to a remote controlled hydraulically actuated adjustable pillow construction.

2. Description of Related Art

As can be seen by reference to the following U.S. Pat. Nos. 3,308,489; 5,497,520; 5,708,999; 5,771,514; and 5,898,963, the prior art is replete with myriad and diverse pneumatically actuated pillow constructions.

While all of the aforementioned prior art constructions are more than adequate for the basic purpose and function for which they have been specifically designed, they are uniformly deficient with respect to their failure to provide a simple, efficient, and practical hydraulic cylinder arrangement wherein a foot pillow having independent foot support surfaces can be selectively varied among a number of different support contours via a remote control.

As anyone who has purchased an adjustable bed is all too well aware, the customer is paying a fairly exorbitant price for a variety of mechanical adjustments that they will never use.

While there are many instances wherein there is a well defined need to provide an elevatable foot rest on a long term basis such as for obesity, heart disease, and chronic back pain which might justify the more expensive solution such as an adjustable motorized full bed support, there are also a number of relatively short term physical conditions such as pregnancy, broken ankles, foot surgery, and periodic lower back pain that can hardly justify the cost of a fully adjustable bed.

As a consequence of the foregoing situation, there has existed a longstanding need for a new and improved portable, low cost, multi position leg pillow support apparatus that can be operated by remote control while the user is in the supine position, and the provision of such an apparatus is the stated objective of the present invention.

BRIEF SUMMARY OF THE INVENTION

Briefly stated, the leg pillow support apparatus that forms the basis of the present invention comprises in general, a foot support unit, a base unit, and a control unit.

As will be explained in greater detail further on in the specification, the support unit comprises a pair of independently actuated foot support members each including a contoured molded foot rest suspended above the base unit by two pairs of hydraulic piston members arranged in a criss cross fashion on the upper portion of the base unit.

The base unit in turn, comprises a base member including a rigid support plate that is engageable with the lower portion of each of the hydraulic piston members and which rests on top of a foam pad element that is adapted to rest firmly on top of a mattress in a non slip fashion.

In addition, each of the hydraulic piston members form a portion of and are responsive to the control unit that includes a remote control member operatively associated with a plurality of stepping motors wherein each stepping motor controls the height of the individual hydraulic pistons to raise and lower.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
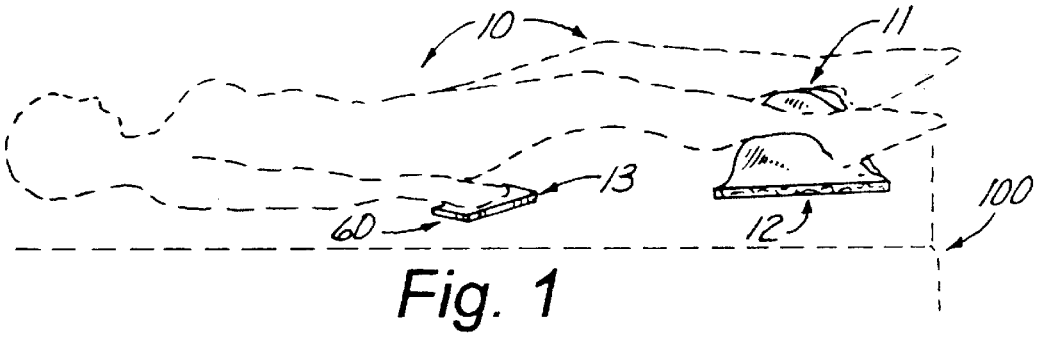
FIG. 1 is a perspective view of the leg pillow support apparatus that forms the basis of the present invention.

As can be seen by reference to the drawings, and in particular to FIG. 1, the leg pillow support apparatus that forms the basis of the present invention is designated generally by the reference number 10. The apparatus 10 comprises in general a support unit 11, a base unit 12, and a control unit 13. These units will now be described in seriatim fashion.

As can best be seen by reference to FIGS. 2 and 6, the support unit 11 comprises a pair of contoured foot support members 20, 20' each having an outer fabric covering 21 over a molded foam foot rest 22 having an inner resilient liner element 23 that is provided with a plurality of thickened recesses 24 whose purpose and function will be described in greater detail further on in the specification.

Figure 2:
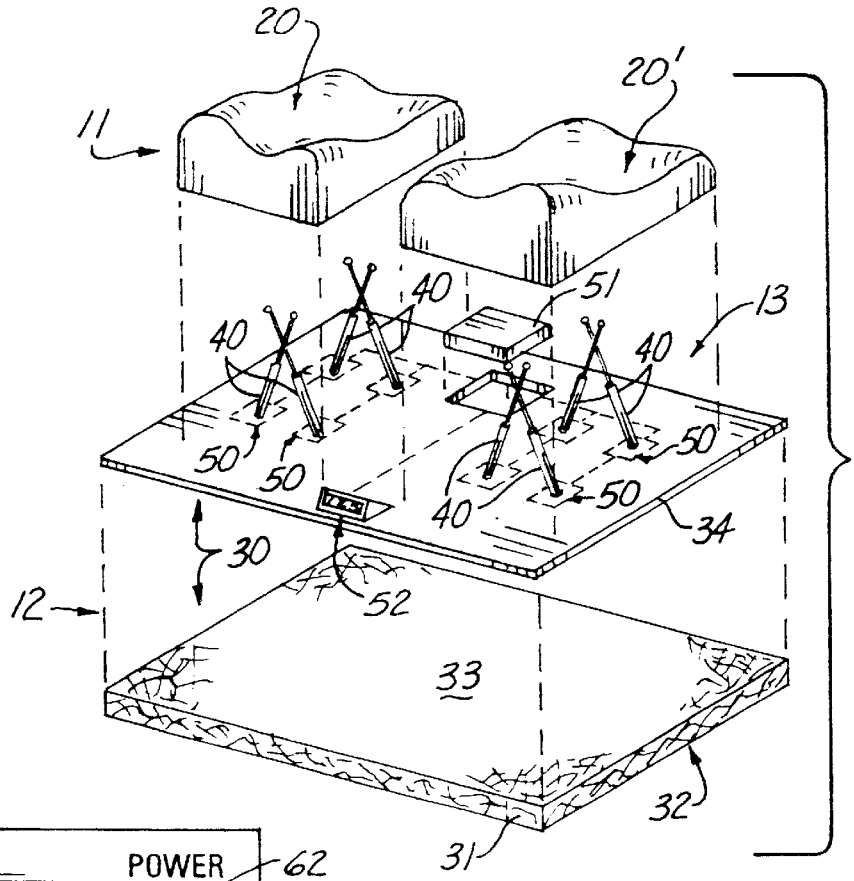
FIG. 2 is an exploded perspective view of the support unit and the base unit.

As is also shown in FIGS. 1 and 2, the base unit 12 comprises a base member 30 that includes a thick foam pad element 31 having a bottom surface 32 that is adapted to frictionally engage the top covering of a conventional mattress 100 and having a top surface 33 which is covered by a generally rigid support panel 34.

Figure 3:
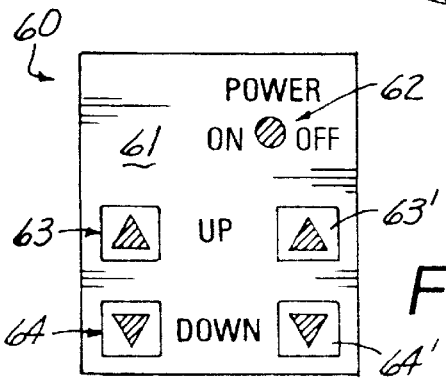
FIG. 3 is an isolated top plan view of the remote control member.
Figure 6:
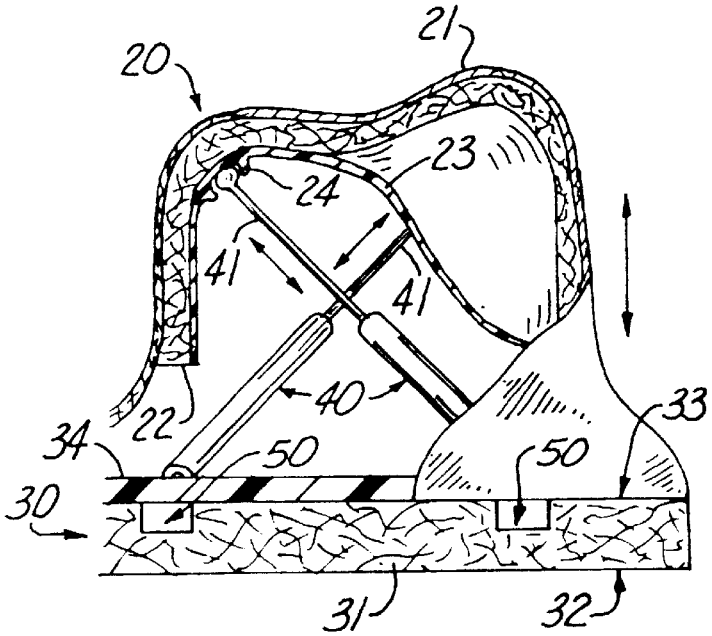
FIG. 6 is a partial cut away view through the side of one of the foot supports.

Turning now to FIGS. 2, 3, and 6, it can be seen that the control unit 13 comprises two separate pairs of hydraulic piston members 40 operatively associated with each of the foot support members 20. Each hydraulic piston member 40 is provided with a stepping motor 50 that is responsive to the output of a remote control member 60.

In addition, each of the hydraulic piston members 40 are provided with a piston rod 41 whose upper end is engageable with a selected recess 24 in the liner element 23 in one of the foot support members 20. The bottom of each hydraulic piston member 40 is pivotally connected to the rigid support panel 34 and connected to one of the stepping motors 50. All of the stepping motors 50 are supplied by a central power source 51.

Furthermore, the power source 51 is connected to a microprocessor 52 that governs the height setting of each of the two separate pairs of hydraulic piston members 40 associated with each foot support member 20 in response to the output of the remote control member 60.

As shown in FIG. 3, the remote control member 60 has a control panel 61 provided with an on/off button 62 and a pair of up 63, 63' and down 64, 64' control buttons wherein one set of control buttons 63, 64 selects either a low, medium or high elevation for one foot support member 20 and the other pair of control buttons 63', 64' selects the desired elevation for the remaining foot support member 20'.

Figure 4:
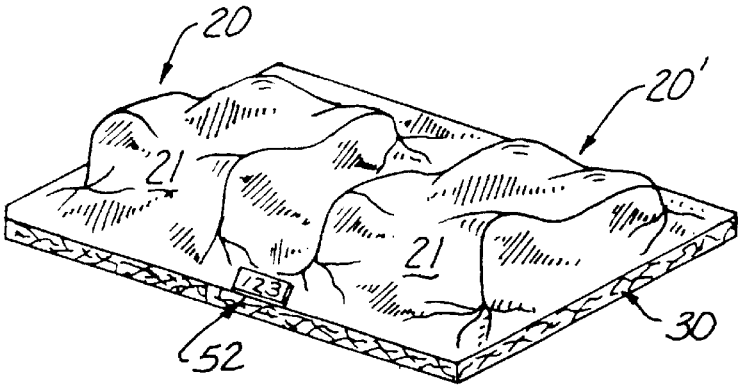
FIG. 4 is a perspective view of the apparatus with both foot supports in the lowered position.
Figure 5:
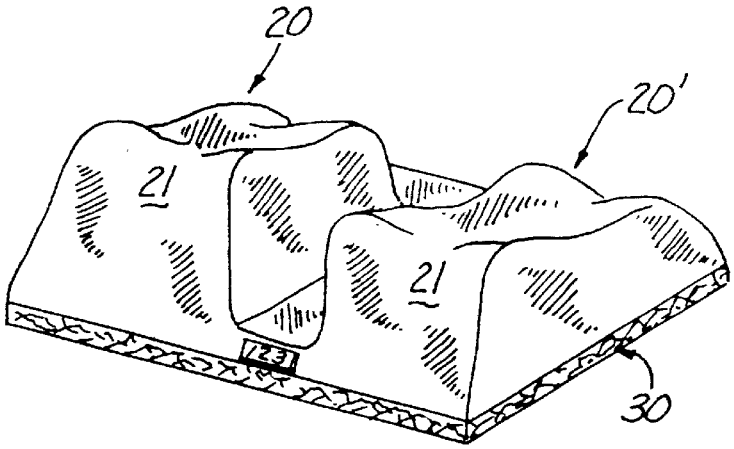
FIG. 5 is a perspective view of one foot support at the maximum elevation and the other foot support at the intermediate elevation.

As can be appreciated by reference to FIGS. 1, 4, and 5, the user can assume a supine position on the mattress 100 and then use the remote control member 60 to independently vary the height of each foot support member 20, 20' to a preferred elevation.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A variable height leg pillow support apparatus comprising:

a support unit including a pair of contoured independent foot support members wherein each foot support member is provided with a molded foam foot rest having a generally resilient inner liner element;

a base unit including a base member having a lower foam pad element and an upper rigid support panel;

a control unit including two separate pairs of hydraulic piston members associated with each one of the foot support members and operatively connected between each one of the foot support members and the rigid support panel; and control means for selectively and independently raising and lowering each one of the foot support members relative to the base member.

2. The apparatus as in claim 1 wherein each of said hydraulic piston members is provided with a stepping motor.

3. The apparatus as in claim 2 wherein said control means includes in part a microprocessor associated with each of said stepping motors.

4. The apparatus as in claim 3 wherein the control means further includes a remote control member operatively associated with said microprocessor.

5. The apparatus as in claim 4 wherein the remote control member has a control panel provided with two pairs of up and down control buttons wherein each set of up and down control buttons regulates the height of one of the pair of foot support members.

6. The apparatus as in claim 5 wherein each of the foot support members is provided with an outer fabric covering.

7. The apparatus as in claim 5 wherein the inner liner element of each foot support member is provided with a plurality of thickened recesses.

8. The apparatus as in claim 7 wherein each of the hydraulic piston members is provided with a piston shaft having an upper end dimensioned to be received in one of the plurality of thickened recesses in one of the pair of foot support members.

9. The apparatus as in claim 8 wherein each of the hydraulic piston members has a lower end that is pivotally associated with the base member.

* * * * *